United States Patent [19]

Kammann

[11] 4,352,326

[45] Oct. 5, 1982

[54] SCREEN PRINTING MACHINE

[75] Inventor: Wilfried Kammann, Bünde, Fed. Rep. of Germany

[73] Assignee: Werner Kammann Maschinenfabrik GmbH, Bünde, Fed. Rep. of Germany

[21] Appl. No.: 175,267

[22] Filed: Aug. 4, 1980

[30] Foreign Application Priority Data

Aug. 8, 1979 [DE] Fed. Rep. of Germany ..... 2932099

[51] Int. Cl.[3] ..... B05C 17/04; B05C 17/06; B41L 13/18

[52] U.S. Cl. ..... 101/123; 101/38 A; 101/39; 101/126

[58] Field of Search ..... 101/38 R, 38 A, 123, 101/126

[56] References Cited

U.S. PATENT DOCUMENTS

| | | | |
|---|---|---|---|
| 3,385,209 | 5/1968 | Freres | 101/38 R |
| 4,048,914 | 9/1977 | Kammann | 101/126 X |
| 4,109,573 | 8/1978 | Strauch | 101/126 X |
| 4,122,768 | 10/1978 | Dubuit | 101/126 X |

*Primary Examiner*—Richard J. Apley
*Assistant Examiner*—A. Heinz
*Attorney, Agent, or Firm*—Howson and Howson

[57] ABSTRACT

A screen printing machine has a carrier for an article to be printed, comprising first and second carrier members interconnected by a transverse connecting member. The carrier is reciprocal along the stencil between an article-receiving and an article-discharge station. The connecting member is adapted to pivot to a position beside the carrier, at at least one of the stations, for access to the carrier.

27 Claims, 10 Drawing Figures

SCREEN PRINTING MACHINE

BACKGROUND OF THE INVENTION

A known form of screen printing machines comprises a screen printing stencil, a squeegee or doctor for displacing a printing agent such as ink through the stencil, and a means for holding the article or material to be printed. The carrier or holder of this machine comprises two parts, one part engaging the article, such as a bottle, at one end and the other part engaging the article at the other end. The two parts of the carrier or holder are interconnected by a transverse member which extends substantially parallel to the longitudinal direction of the article and which is arranged at the side of the article which is remote from the stencil.

It will be appreciated that the above-discussed screen printing machine is of a thoroughly simple construction. The printing capacity of such a machine is very low, although the number of operators required is comparatively high, so that these machines represent a combination of low capacity and high labour costs. This is essentially because the articles must be inserted into the screen printing machine, that is to say, fitted to the holder thereof, by hand, and also have to be manually removed after the printing operation has been carried out. It is not possible for a screen printing machine of this kind to be incorporated into a series of successively disposed apparatuses for treating the article, with automatic feed and discharge of the article.

Another known form of screen printing machine does not suffer from the above-indicated disadvantages. However, these machines are substantially more complicated and more expensive in regard to their construction, and also in regard to equipment for controlling the general mode of operation thereof. This is due inter alia to the fact that the two parts of the article carrier are mounted independently of each other so that each part of the holder must be connected to separate components for transmitting or producing the reciprocating movement of the article holder, which is conventionally produced in machines of this kind.

SUMMARY OF THE INVENTION

An object of the invention is to provide a screen printing machine which does not suffer from the disadvantages referred to above.

A further object of the invention is to provide a screen printing machine which enjoys a high printing capacity, without being substantially more expensive than the known machines discussed above.

A still further object of the invention is to provide a screen printing machine which can be automatically fed with articles to be printed and from which the printed articles can be automatically removed.

A further object of the invention is to provide a screen printing machine which can be incorporated into a production line to permit operations to be carried out on articles upstream and downstream of the screen printing machine, with automatic movement of the articles between the various machines of the production line.

These and other objects are achieved by a screen printing machine wherein the carrier or holder for the article to be printed is reciprocable between a station in which the article is received, and a station in which the printed article is removed from the machine. The screen printing machine has a connecting member for connecting the two parts of the carrier, the connecting member extending substantially parallel to the longitudinal direction of the article, or transversely with respect to the direction of movement of the article during the printing operation, the member being disposed at the side of the article which is remote from the screen printing stencil. The connecting member is laterally pivoted out of a position below the article, in both stations in such a way that the carrier and the article carried by the carrier is accessible from below.

The construction in accordance with the present invention provides that the article or articles to be printed can be fed into the receiving station from below, using conventional means, and can fall downwardly out of the carrier without hinderance at the discharge station, so that the article can be fed to and discharged from the machine in a proper and orderly manner. The movement of the carrier from the receiving station to the discharge station also means that the output or capacity of the machine is increased, as the article-conveying step which is required in any case is performed at the same time as the article-printing operation. The connecting member which connects the two parts of the carrier together will generally extend perpendicularly with respect to the line of movement of the article carrier or parallel to the shortest line between the two parts of the carrier. The pivotability of the connecting member can be achieved by simple means, as it is readily possible for the pivotal movement thereof to be derived from the reciprocating movements of the article carrier.

It will be noted therefore that the screen printing machine according to the present invention enjoys the advantages of the above-discussed known machines, but without suffering from their disadvantages.

The arrangement is preferably such that the connecting member or the article carrier is pivoted in each of the two stations, towards the respective other station.

It has been found advantageous for only one of the two members or parts of the carrier to be carried by a component which transmits the reciprocating motion; that is to say, no special guide and/or support members are required for the second member of the carrier. On the contrary, the connecting member represents a kind of support or carrier arm which is mounted on one of the two guide members or on a component which carries the guide member. Particularly when dealing with articles which are in the nature of bottles or a like configuration, it is advantageous for the part of the carrier which engages the bottom of the bottle, to engage directly or indirectly the component for transmitting the reciprocating motion.

The article carrier may be connected to or carried by the carriage which carries the squeegee for distributing the printing agent over the surface of the stencil, or the carrier may be carried by or connected to the reciprocable carriage for the stencil. This arrangement will be used when the articles to be printed, or the surfaces thereof which are to be printed, are substantially flat or are at any event of such a configuration that it is not possible or necessary for the surface to be printed to be rolled against the screen printing stencil.

The axis of pivotal movement of the connecting member may coincide with the longitudinal axis of the article to be printed, when the article is for example of a round configuration such as a bottle, and this gives a particularly simple design configuration in respect of the carrier and the members for producing the pivotal movement.

For printing articles which are capable of being rolled against the stencil during the printing operation, such as bottles, the article carrier may be provided with a rotary drive which produces rotary or pivotal movement of the article carrier and the connecting member thereof, in dependence on the displacement which is performed in the course of the printing operation. In a simple structure which provides this interdependence of movement, a gear wheel, friction wheel or the like is provided to co-operate with a toothed rack, a friction bar or the like. The wheel is non-rotatably connected to the carrier or to the shaft on which the carrier is mounted. The axis of rotation of the shaft may coincide with the axis of rotation of the members of the carrier or the article to be printed.

In another form of the machine according to the invention, a preferably bar-type guide means is mounted on the carrier, outside of the pivotal axis, and is pivotally connected to a guide means which is reciprocable along a preferably linear guide member. In this case also the pivotal motion may be derived from the reciprocating motion of the article carrier, and the axis of pivotal movement of the carrier may coincide with the axis of rotation of the article to be printed.

It will first be noted that the screen printing machine described hereafter is described with reference to printing on the surface of an article of bottle-like configuration eg a bottle or can. It will be appreciated that articles of different forms may be printed on by the machine.

DESCRIPTION OF PREFERRED EMBODIMENTS

Figure 1A:
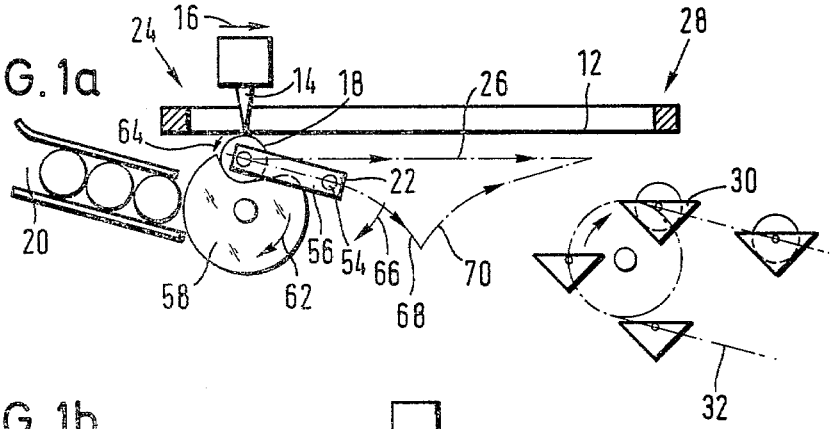
FIGS. 1*a* through 1*d* each show a diagrammatic front view of the printing mechanism of a screen printing machine, in four successive working phases.
Figure 1B:
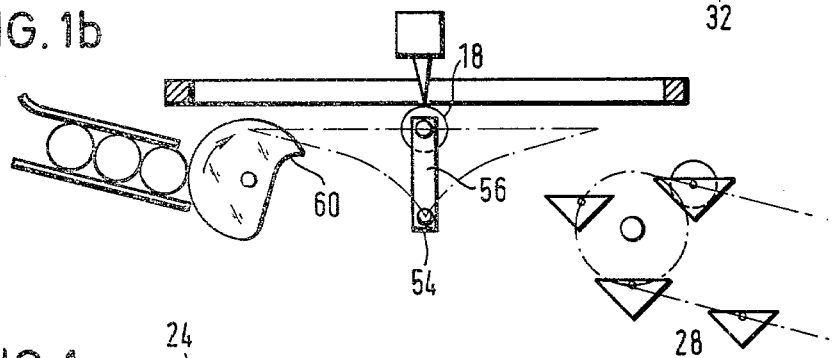
Figure 1C:
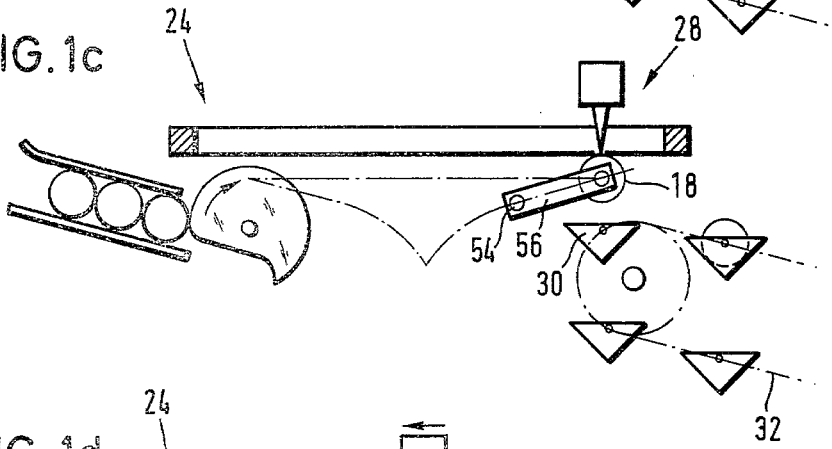
Figure 1D:
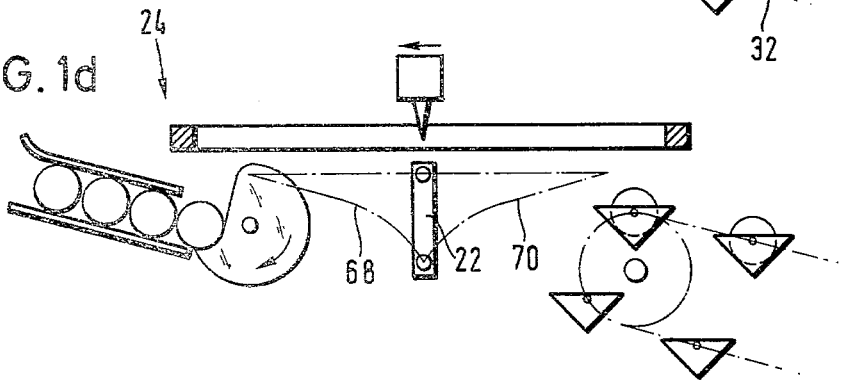

Reference will first be made to FIGS. 1*a* through 1*b* which show an embodiment of a screen printing machine according to the invention, comprising a flat screen printing stencil 12 which may be for example stationary and which is co-operable with a reciprocable squeegee or doctor 14 for distributing a printing agent such as ink or dye over the surface of the screen and thus on to the article to be printed. During the actual printing operation therefore, the squeegee 14, referred to hereinafter generally as the squeegee, is moved in the direction indicated by arrow 16. During its movement, it bears in the usual manner against the upper surface of the stencil, in order thereby to press the stencil against the article or material 18 to be printed, referred to herein generally as the article. During the return movement (see FIG. 1*d*), the squeegee 14 is lifted somewhat from the stencil.

In the description of both of the embodiments illustrated herein by way of example, the articles 18 to be printed are of circular cross-sectional configuration so that they can be rolled against the stencil 12, such as bottles. They are fed to the printing mechanism in a guide means or track 20 formed by rails, bars or the like structure, reaching a receiving station indicated generally by 24 at which the articles are taken over by a carrier or holder 22.

Dash-dotted line 26 in FIGS. 1*a* through 1*d* indicates the path covered by the article 18 as it moves from the receiving station 24 in the course of a printing operation. Disposed at the end of the above-mentioned path 26 is a discharge station 28 at which the article is released, after conclusion of the printing operation, so that the article can fall into a dish or bowl-like container 30 of a conveyor member 32, which is disposed below the article carrier 22 when it is in position in the discharge station 28.

Figure 2:
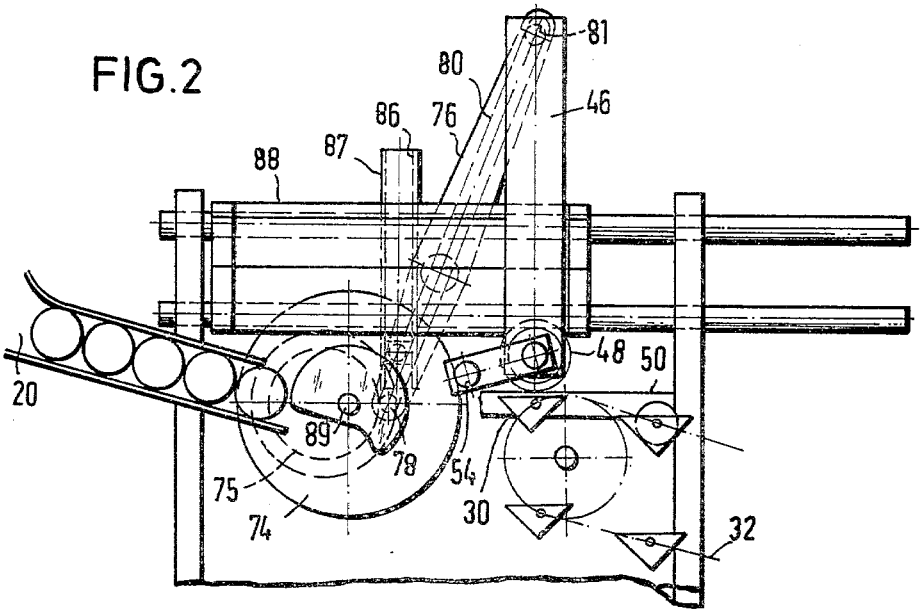
FIG. 2 shows a front view of drive and control means of a printing station of a screen printing machine, although the actual printing mechanism is not shown for the sake of simplicity of the drawing.
Figure 3:
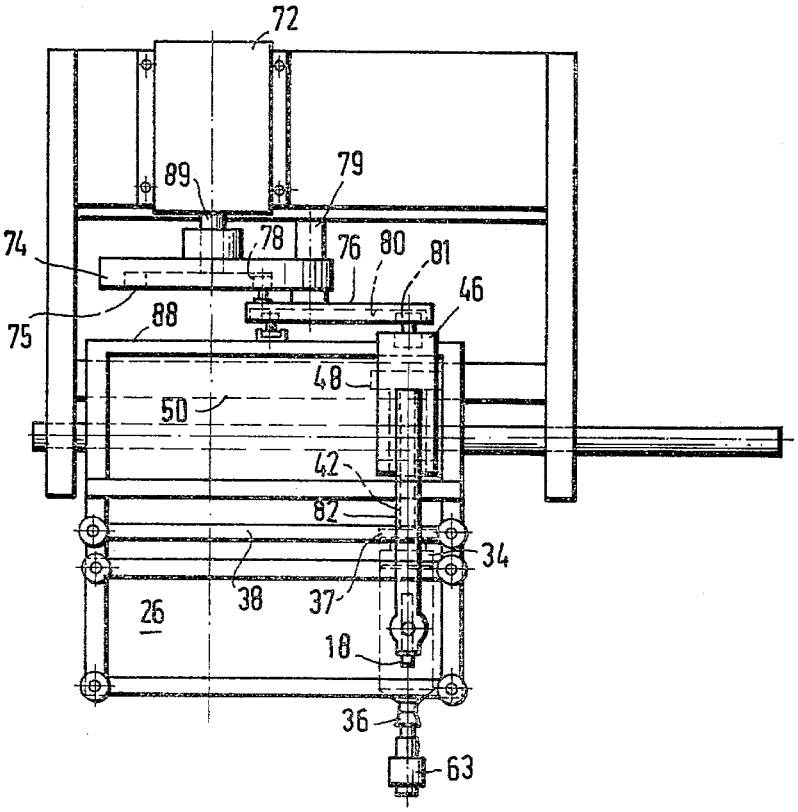
FIG. 3 shows a plan view of the FIG. 2 structure.
Figure 4:
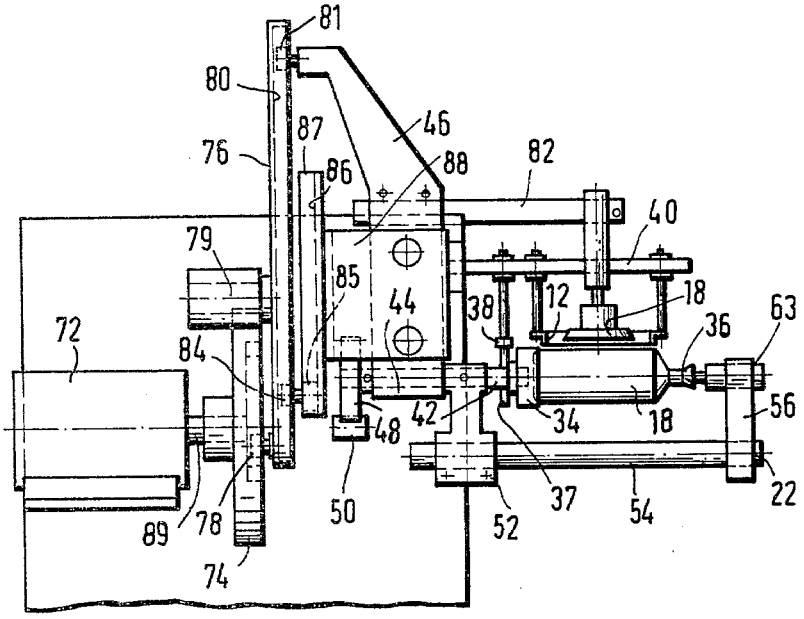
FIG. 4 shows a side view of the FIG. 2 structure, as seen from the right-hand side in FIG. 2, and FIGS. 5*a* through 5*c* are views corresponding to FIGS. 1*a* through 1*d*, of another embodiment of the machine.

Reference will now be made to FIGS. 2 through 4 and in particular FIG. 4, for the structure and design of the carrier 22. The carrier 22 comprises two holder members 34 and 36, of which the holder member 34 is fitted to the bottom of the article which in this illustration is of a bottle configuration. The article 18 engages into the holder member 34. The holder member 36 is in the form of a tapered mandrel or like member which engages into the opening at the mouth of the neck of the bottle which constitutes the article 18, and can possibly be used to introduce compressed air into the article 18 during the printing operation. Fixedly connected to the holder member 34 is a rotary drive member such as a wheel, illustrated as a gear wheel 37 which meshes with a toothed rack 38 carried by the holder 40 for the screen printing stencil 26. The rotary movement of the holder member 34 and thus the article 18, which is produced when the carrier 22 is reciprocated, ensures that the article 18 rotates at a peripheral speed which corresponds to the linear speed at which the article is displaced between the stations 24 and 28, during the printing operation, thereby to guarantee satisfactory printing.

The gear wheel 37 and the holder member 34 are carried by a shaft 42 so as to be rotatable relative thereto. The shaft 42 is in turn carried by an extension portion 44 of a carriage 46 which carries the squeegee 14. A further rotary drive member such as a gear wheel 48 is fixedly mounted on the end of the shaft 42 which is remote from the gear wheel 37, and meshes with a stationary drive member such as a toothed rack or bar 50.

A substantially radial arm 52 is fixedly mounted on the shaft 42 between the extension portion 44 of the carriage 46 and the gear wheel 37. The arm 52 carries a transverse connecting member 54 which extends substantially parallel to the common axis of the two holder members 34 and 36 and thus extends parallel to the longitudinal axis of the article 18 and at a distance therefrom, which distance depends on the diameter of the largest article which is intended to be printed in the machine. The transverse member 54 is provided with an arm 56 at its end portion which is remote from the arm 52. The arm 56 carries the holder member 36 which engages into the opening in the neck of the bottle as described above. The portions 52, 54 and 56 are combined together to form a generally U-shaped carrier assembly for the article 18, which carrier assembly performs pivotal movements in the course of the reciprocating motion between the two stations 24 and 28, by virtue of the fixed connection to the shaft 42 and the drive produced by the gear wheel 48. The arrangement is such that, as shown in FIG. 1*a*, the carrier 22 in the receiving station 24 is pivoted towards the discharge station 28 and thus into a virtually horizontal position, with the result that the region between the two holder members 34 and 36 is readily accessible from below, without any impediment by virtue of the transverse member 54. It is thus possible, when the carrier 22 is in the station 24, for the respective first article in the guide means 20 to be moved from the guide means 20 into the region between the two holder members 34 and 36, by means of a transfer disc or roller 58 provided at its periphery with a recess 60 or the like which is adapted to the dimensions and in particular the cross-sectional configuration of the article 18, in the course of a rotary movement of the transfer disc or roller 58 in the direction indicated by arrow 62 (FIG. 1*a*).

Referring to FIG. 4 the two holder members 34 and 36 are arranged and constructed to be axially displaceable relative to each other, in the usual way. Thus, the holder member 36 can be displaced axially by actuation of a piston cylinder assembly 63. Thus, after the article which has just been transferred by the disc or roller 58 is between the two holder members 34 and 36, the distance between the holder members is reduced, by actuating the piston-cylinder assembly 63, in such a way that the article is gripped at the bottom and at the neck, in the case of a bottle, in the manner shown in FIG. 4. The printing operation can then begin. For this purpose, the carrier 22 with the article 18 and the squeegee 14 are displaced in the direction indicated by the arrow 16 in FIG. 1*a*, to the discharge station 28. When this occurs, the article which is displaced along the line 26 is rolled against the stencil 12, more particularly against the underneath surface thereof, the rolling motion being indicated by arrow 64 in FIG. 1*a*. At the same time, by virtue of the co-operation between the gear wheel 48 and the toothed rack 50, the shaft 42 which carries the arm 52 undergoes a rotary movement in the opposite direction, which causes pivotal movement of the arm 52 and thus the member 54 carried thereby and the arm 56 mounted thereon, in the direction indicated by arrow 66 in FIG. 1*a*. The path of movement covered by the member 54 in the course of the linear displacement, parallel to the line 26, of the article 18 and the carrier 22, is shown by the two curved lines 68 and 70 in FIGS. 1*a* through 1*d*. After covering half its distance of movement, the member 54 has reached the point of intersection of the two curves 68 and 70 so that the member 54 now depends vertically below the article 18 (see FIG. 1*b*). In the course of further movement towards the discharge station 28, the member 54 is pivoted into its second limit or end position in which the two arms 52 and 56 are pivoted back towards the station 24 and the member 54 is consequently laterally of the article 18, at such a distance therefrom that, when the article 18 is released by axial disengagement movement of the two holder members 34 and 36, more particularly the holder member 36, the article 18 will be readily able to fall downwardly into the respective container 30 disposed therebelow, of the conveyor member 32 for receiving the printed articles, without such downward movement of the article being impeded by the carrier 22 or in particular the member 54.

The squeegee 14 and the carrier 22 then return to the receiving station 24. When this movement takes place, the carrier 22 again performs a pivotal movement, in the course of which the transverse member 54 follows the path of movement denoted by the two curves 70 and 68, except that this time it moves along those curves in the opposite direction to its direction of movement during the printing operation, until the carrier 22 finally occupies the position shown in FIG. 1*a*, at the receiving station 24.

Referring again to FIGS. 2 through 4, the illustrated screen printing machine is driven by a motor 72 which rotates a cam disc 74, possibly by way of an interposed step-down or reduction transmission. Referring now therefore more particularly to FIGS. 3 and 4, the transmission arrangement includes a cam follower roller 78 which is carried by a double-armed lever 76 and which engages with cam surface 75 of the dam disc 74. The lever 76 is pivotal about a spindle or shaft 79 and is provided with a guide means 80, for example in the form of a slot, for a follower roller 81 which is carried by the squeegee carriage 46. Mounted on the carriage 46 is a carrier arm 82 which carries the squeegee 14 in such a way that the squeegee is vertically adjustable. The above-described shaft 42 is mounted rotatably in the extension portion 44 of the carriage 46.

By suitably selecting the configuration of the cam surface 75 and the position of the cam rollers 78 and 81, the cam disc 74 can produce the reciprocating movement of the squeegee 14 and the carrier 22.

Furthermore, the embodiment shown by way of example in FIGS. 2 to 4 also makes it possible for the stencil 14 to be moved, for example during the printing operation, in the opposite direction to the direction indicated by arrow 16 in FIG. 1*a*, or in the direction of movement indicated by the arrow 16, although in that case it is at a lower speed than the speed of movement of the squeegee 14 and the article 18. For this purpose, as shown in FIG. 4, a second cam follower roller 84 is associated with the lever 76 and co-operates with a sliding member 85 which is displaceable within a guide means 86 of a rail or bar 87 and which is arranged so that it can be fixed in a given position. The rail or bar 87 is fixedly connected to the carriage 88 which carries the screen printing stencil 12. The nature and extent of the movement of the stencil 12 can thus be determined in dependence on the position of the member 85 and accordingly the cam follower roller 84. Thus, the movement of the stencil 12 is in the opposite direction to the movement of the squeegee 14 and the article 18, as long as the cam follower roller 84 is below the axis 79 of pivotal movement of the lever 76. When the cam follower roller 84 is in a position above the axis 79, the movements of the squeegee 14, the article 18 and the stencil 12 are in the same direction, but with a relative speed, that is to say, a speed difference, as between the squeegee and the article on the one hand and the stencil on the other hand.

The drive shaft 89 (FIG. 4) for the cam disc 74 also carries the transfer roller or disc or discs 58.

Figure 5A:
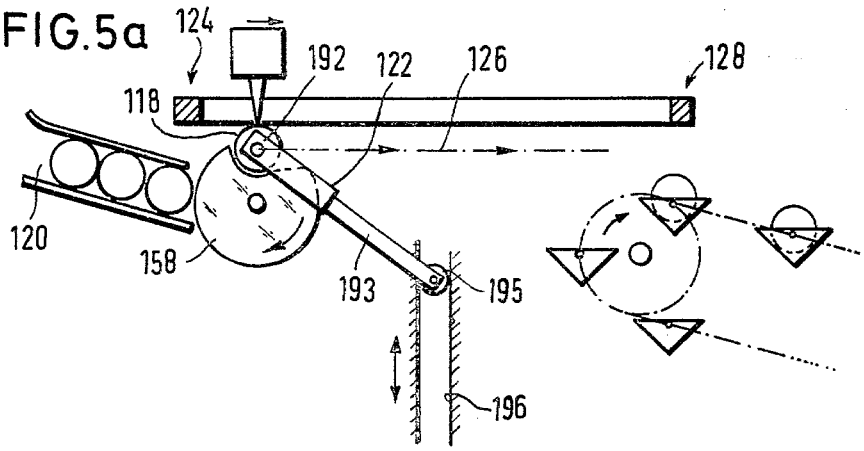
Figure 5B:
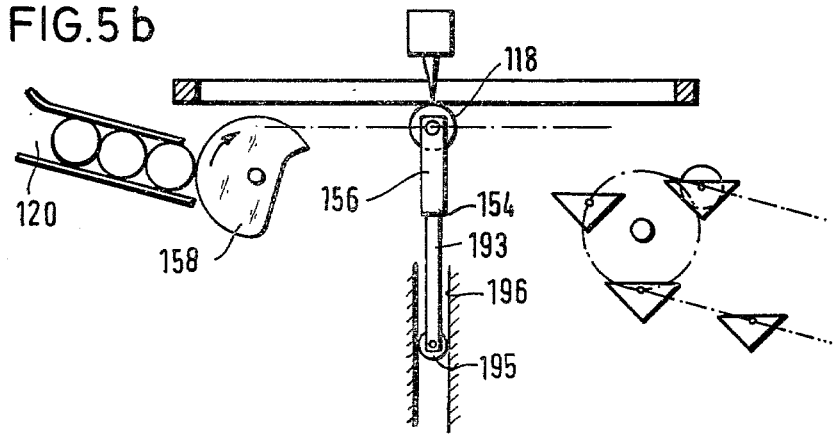
Figure 5C:
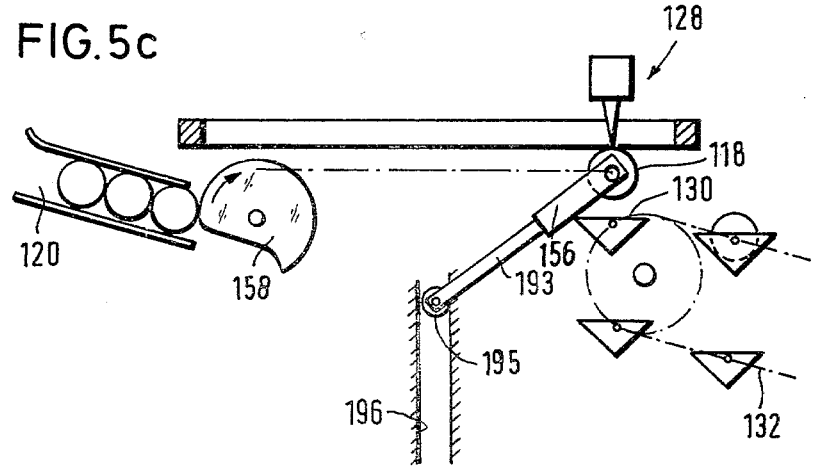

Reference will now be made to FIGS. 5*a* through 5*c* wherein components which are the same as components in the above-described embodiment described with reference to FIGS. 1*a* through 4 are denoted by the same reference numeral but increased by 100. Thus, the guide track or guide means 20 of FIGS. 1*a* through 1*d* becomes the guide means 120 in FIGS. 5*a* through 5*c*. The only difference of substance between the two embodiments is that the carrier 122 carries a control means such as an arm 193 which is mounted on the holder 122 at a distance from the pivotal axis 192 thereof, which axis coincides with the axis of rotation of the article 118.

The other end of the arm 193 rotatably carries a cam follower roller 195 guided for vertical reciprocating movement within a guide means 196 which is preferably of a linear configuration. In the course of the movement of the carrier 122 along the line 126 from the receiving station 124 into the discharge station 128, the cam follower roller 195 is initially moved downwardly, with a corresponding pivotal movement of the arm 193 and the carrier 122, until, in the middle of the movement along line 126, the cam follower roller 195 reaches its lowermost position which corresponds to the position of the components in which the control arm 193 and the arm 156 of the carrier 122 extend vertically, as shown in FIG. 5*b*. In this position, as in the embodiment described above with reference to FIGS. 1*a* through 1*d*, the transverse member 154 is disposed vertically below the article 118. In the course of the further movement towards the right into the end position shown in FIG. 5*c*, the cam follower roller 195 is moved upwardly again into a limit position which corresponds to the limit position shown in FIG. 5*a*. At the same time, the control arm 193 is pivoted, also entraining the carrier 122, in such a way that the carrier 122 is again disposed in the discharge station 128 laterally beside the article 118, so that the article can thus fall without hinderance through the carrier downwardly into the container 130, in order to provide for proper and orderly transfer of the article from the carrier to the conveyor member 132 which extends downstream of the discharge station 128.

When this operation has been concluded, the components return to the positions shown in FIG. 5*a* in which the carrier 122 is pivoted laterally by the control arm 193 so that here also the region below the space between the two parts of the carrier 122 is freely accessible so that the following article can be automatically transferred from the guide means 120 to the carrier 122, by way of the transfer roller or disc or discs 158.

In other respects, as discussed above, the embodiment shown in FIGS. 5*a* through 5*c* is substantially the same as the embodiment of FIGS. 1*a* through 1*d*.

The conveyor means 32 or 132 may be a part for example of a drying device through which the printed articles are passed, directly after the printing operation.

It will be appreciated that the foregoing-described embodiments of the screen printing machine according to the invention are given only by way of illustrative example thereof, and that various modifications, alterations and substitutions may be made therein without thereby departing from the spirit and scope of the present invention.

I claim:

1. A screen printing machine comprising: means for mounting a screen printing stencil; a squeegee means; carrier means, comprising two carrier members, for engaging an article to be printed in two spaced regions thereof, with one carrier member being engageable with said article at one region thereof, and the other carrier member being engageable with said article at another region thereof spaced from said one region, means for reciprocating the carrier means in a path between a first station for receiving an article to be printed and a second station for discharge of the printed article; and a connecting member interconnecting the two carrier members and extending substantially parallel to the direction of the spacing between the two carrier members and substantially perpendicular to the path of the carrier means, the connecting member being arranged so that the paths of the carrier members are located between the connecting member and the stencil mounting means; and means for pivoting the connecting member so that in both said stations it is located in a position remote from a position below said article; and in which the axis of the pivotal movement of the connecting member moves with the carrier means as the carrier means moves in said path between the first and second stations.

2. A machine as set forth in claim 1 wherein only one of said two carrier members is connected to a component of said means for reciprocating said carrier means.

3. A means as set forth in claim 2 wherein said one carrier member is carried by said component.

4. A machine as set forth in claim 1 including a stencil and means for displacing said stencil parallel to the movement of said squeegee means, during a printing operation.

5. A machine as set forth in claim 1 including a reciprocating carriage on which said squeegee means is mounted and in which said carrier means is connected to said carriage.

6. A machine as set forth in claim 1 wherein said stencil mounting means includes a reciprocating carriage and said carrier means is connected to said carriage.

7. A machine as set forth in claim 1 wherein said pivoting means effects pivotal movement of said connecting member at each said station towards the respective other said station, about an axis extending at least substantially parallel to the direction of the spacing between said two carrier members.

8. A machine as set forth in claim 1 wherein the axis of pivotal movement of said connecting member extends through said carrier members.

9. A machine as set forth in claim 1 for printing on a round article, including rotary drive means, and wherein said carrier means is operatively connected to said rotary drive means for producing rotational movement of said carrier means in dependence on displacement thereof in the course of a printing operation.

10. A machine as set forth in claim 9 wherein said rotary drive means includes a shaft carrying said carrier means.

11. A machine as set forth in claim 10 wherein said carrier means is of a generally U-shaped configuration including said connecting member.

12. A machine as set forth in claim 10 wherein the axis of rotation of said shaft coincides with the axis of rotational movement of said carrier member.

13. A machine as set forth in claim 1 in which said means for pivoting the connecting member comprises control means connected to said carrier means, for producing pivotal movement of said connecting member during reciprocating movement of said carrier means.

14. A machine as set forth in claim 13 wherein said control means is a control arm.

15. A machine as set forth in claim 13, including a guide means and a guide member, and wherein said control means pivotally carries said guide means, and said guide means is mounted for reciprocating motion in said guide member.

16. A machine as set forth in claim 1 further including means for automatically feeding articles to be printed to said carrier means.

17. A machine as set forth in claim 16 wherein said feeding means includes at least one conveyor means for receiving articles to be printed and passing the same to said carrier means.

18. A machine as set forth in claim 17 wherein said conveyor means is a rotatable member having a peripheral surface provided with at least one recess for receiving a said article.

19. A machine as set forth in claim 18 wherein said rotatable member is a roller member.

20. A machine as set forth in claim 18 wherein said rotatable member comprises at least one disc.

21. A machine as set forth in claim 1 and further including means for automatically carrying printed articles away from said machine.

22. A machine as set forth in claim 21 wherein said means for carrying said articles away includes a receiving means positioned below said carrier means when said carrier means is in said discharge station.

23. A machine as set forth in claim 22 wherein said receiving means is part of a conveyor member for carrying printed articles.

24. A screen printing machine comprising: means for mounting a screen printing stencil; a squeegee means; an assembly movable along said stencil therebelow between first and second stations and including means comprising a first member for engaging said article at a first position thereof, means for moving said assembly in a direction along said stencil, means comprising a second member for engaging said article at a second position thereof disposed at a spacing from said first position in a direction perpendicular to the direction of movement of said assembly, and connecting means connecting said first and second members together and extending substantially parallel to the direction of said spacing, said connecting means being located so that the paths of movement of said first and second members are located between said connecting means and said stencil mounting means; and means for pivoting said connecting means about a pivot axis whereby said connecting means is positioned at least partly laterally of said space between said first and second members, in at least one of said stations, the pivot axis of said connecting means being carried with said movable assembly.

25. A machine as set forth in claim 24 wherein one of said first and second members is carried by said connecting means.

26. A machine as set forth in claim 24 wherein said at least one station is a station at which said article after printing is discharged from said assembly.

27. A machine as set forth in claim 24 wherein said pivoting means pivots said connecting means to a position at least partly laterally of said space between said first and second members, in both said stations.

* * * * *